US005901531A

United States Patent [19]

Rogers

[11] Patent Number: 5,901,531

[45] Date of Patent: May 11, 1999

[54] RIDING SADDLE SAFETY DEVICE

[76] Inventor: Vicki E. Rogers, 2 Apache Dr., Searcy, Ark. 72143

[21] Appl. No.: 08/950,561

[22] Filed: Oct. 15, 1997

[51] Int. Cl.[6] ..... B68C 1/00

[52] U.S. Cl. ..... 54/44.1

[58] Field of Search ..... 54/44.1, 44.7, 54/66

[56] References Cited

U.S. PATENT DOCUMENTS

| | | | |
|---|---|---|---|
| 558,029 | 4/1896 | Baur . | |
| 1,397,128 | 11/1921 | Keithley . | |
| 2,128,159 | 8/1938 | Morgan | 36/62 |
| 4,799,709 | 1/1989 | Francois | 280/801 |
| 4,905,458 | 3/1990 | Johnston et al. | 54/44.1 X |
| 4,910,818 | 3/1990 | Grabill et al. | 5/443 |
| 5,029,434 | 7/1991 | Erickson | 54/44.1 |
| 5,232,267 | 8/1993 | DeMatteo et al. | 297/467 |
| 5,423,164 | 6/1995 | Schneider | 54/44.1 |

FOREIGN PATENT DOCUMENTS

| | | | |
|---|---|---|---|
| 2071986 | 9/1981 | United Kingdom | 54/44.1 |

*Primary Examiner*—Robert P. Swiatek
*Attorney, Agent, or Firm*—Ray F. Cox, Jr.

[57] ABSTRACT

A safety device for use by a horseback rider. Industrial strength hook and loop fasteners secure the rider to the saddle. Loop material is affixed to the saddle and complementary hook material is secured to the rider. By engaging the hook material with the loop material, a sufficient binding force is established to prevent the rider from being thrown from the horse. A simple outward leg movement is sufficient to peel away the hook from the loop material. The invention may be used in conjunction with either the English equestrian style saddle, the western style saddle or the jockey saddle. Each includes a safety girth that attaches to the saddle or around the saddle and which contains a segment of loop type fastening material. A matching segment of hook type fastening material is fastened either to the legs or to the boots of the rider.

15 Claims, 7 Drawing Sheets

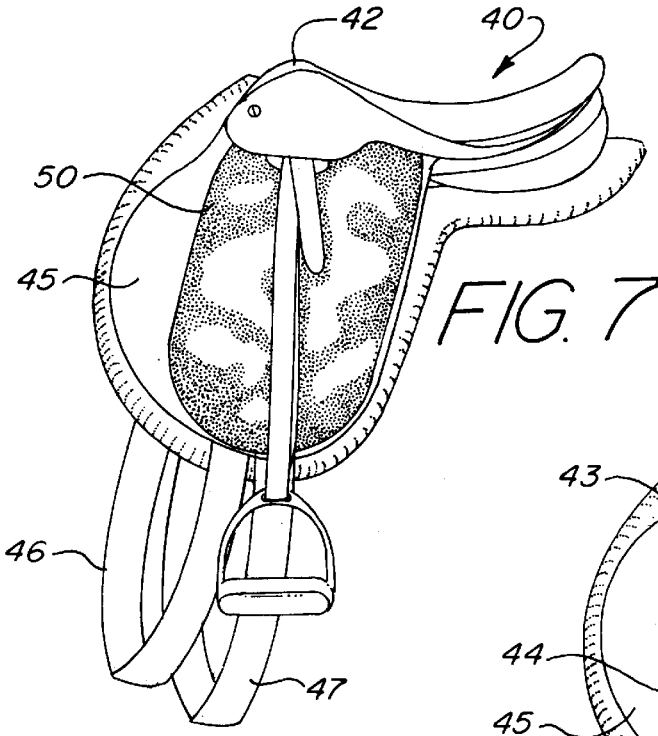
FIG. 7
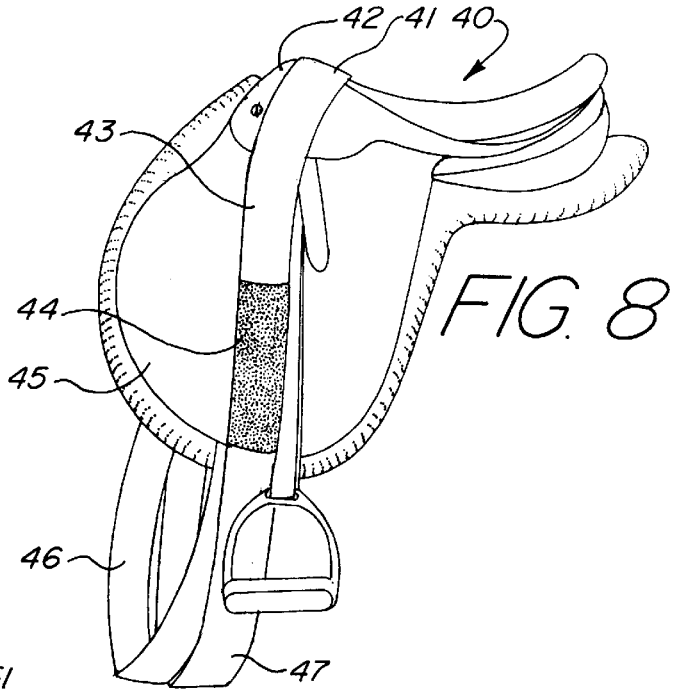
FIG. 8
FIG. 9
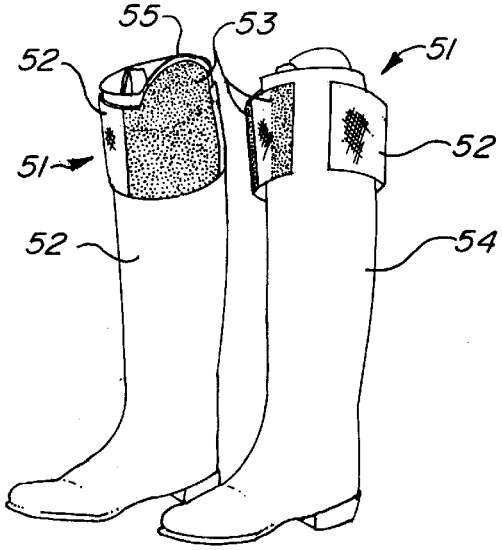

RIDING SADDLE SAFETY DEVICE

BACKGROUND OF THE INVENTION

The present invention relates generally to safety devices to prevent horse riding accidents, and in particular, to the use of hook and loop fasteners attached to the rider and the saddle to assist the rider in avoiding being thrown from the horse in case of accidents.

The prior art patents show that the problem of securing a rider to a saddle has been recognized for some time. An early patent is U.S. Pat. No. 558,029 issued in 1896. This riding saddle safety attachment includes a stud button secured to the side flap of the saddle along with a snap-eye secured to the rider which can be used to engage the head of the stud.

Another early patent that discloses a method of safely attaching a rider to a saddle is U.S. Pat. No. 1,397,128 issued to Keithley in 1921. Keithley discloses a hinged flap on the saddle which is held against the legs of the rider by spring pressure. Although the Keithley device is primarily intended to provide protection to the rider's legs, it is noted that the pressure of the pad against the knee and upper portion of the leg of the rider assists the rider to retain his position upon the saddle.

Of similar effect is U.S. Pat. No. 2,128,159 issued to Morgan on Aug. 23, 1938. This is also a safety device to help riders maintain their position on a saddle which does not, however, require modification to the saddle itself. Morgan suggests a device which is buckled about the upper leg or in some cases the lower leg of the rider and which has projections or ridges or suction cups to grip the saddle between the legs of the rider. Morgan discloses the use of a plurality of buckles and straps to hold a pad of gripping material on the leg of the rider to interact with the saddle.

A completely different approach to the problem is disclosed in U.S. Pat. No. 5,029,434 issued to Erickson for a saddle riding harness kit. Erickson is primarily intended to secure a disabled individual to a saddle.

None of the patents mentioned above employ hook and loop type fasteners. However, hook and loop type fasteners have been used as safety devices in a number of situations. For example, U.S. Pat. No. 5,232,267 discloses the use of hook and loop type fasteners to secure an infant to a highchair. Likewise, U.S. Pat. No. 4,910,818 discloses the use of hook and loop type fasteners to position the legs of a patient to maintain the knees in flexion. This patent discloses a hook or loop type fastener on a pillow along with the complementary fasteners attached to the legs of the patient.

Neither of the two patents mentioned above using hook and loop type fasteners, however, address the particular problem addressed in the present invention which is securing a rider to a riding saddle.

U.S. Pat. No. 4,799,709 issued to Francois in 1989 addresses the problem of providing a safety harness for the rider of an all-terrain vehicle. Francois discloses leg restraints attached to the rider which are removably attached by hook and loop type fasteners to a strap secured to the body of the vehicle and which passes over the saddle of the vehicle.

U.S. Pat. No. 5,423,164 issued to Schneider on Jun. 13, 1995 uses hook and loop type fasteners to secure a rider to a horse. However, Schneider discloses a device to secure the rider of a horse to the horse without the need for a rigid saddle. In this invention a fabric cover over the horse's back is provided with hook and loop fastener strips. The mating fastener strips are attached to the legs of the rider. The Schneider device is not specifically designed as a safety device, although it is noted that this device prevents the rider from bouncing when riding the horse.

SUMMARY OF THE INVENTION

The present invention overcomes the limitations and disadvantages of the prior art by providing for a device for improving the safety of horseback riding by using industrial type hook and loop fasteners to secure the rider to the saddle.

There are three major embodiments of the invention—for the western saddle, the equestrian saddle, and the jockey saddle. Each of the major embodiments also has individual variations. Each of the various embodiments however has the same general characteristics. Each includes a safety girth that attaches to the saddle or around the saddle and which contains a segment of loop type fastening material. Each of the embodiments also includes a matching segment of hook type fastening material which is fastened either to the legs or to the boots of the rider. In certain embodiments it is desirable that the device that attaches to the saddle uses a segment of an elastic material to hold the device tautly to the saddle.

The first embodiment is the western saddle version. The safety girth comprises a strip of webbing material that passes over the saddle. The webbing may be of various types of materials so long as the webbing is relatively inelastic, such as polypropylene, nylon or light weight leather. This is desirable to ensure that the loop fastening material is positioned appropriately on the saddle. The loop fastening material must be positioned appropriately for interconnection with the hook fastening material on the rider.

The webbing terminates on either side of the saddle in a patch of loop type fastening material. From the loop fastening material an elastic strap bifurcates and passes on either side of the portion of the saddle known as the fender. (The stirrups attach to the ends of the fender.) The two portions of the bifurcated elastic strap pass on either side of the fender and from thence under the horse where the two portions join together into a single strap that passes around and under either side of the horse. The two ends of the elastic material are joined together by buckles, by hook and loop fastening material or other means known in the art. On the western saddle version the portions of the device that attach to the rider are simply straps of webbing material (desirably nylon) with hook type fastening material patches on the inside of the rider's legs above the knee where they are positioned to engage the loop material on the saddle safety girth. The nylon straps are fastened about the rider's leg with hook and loop fastening material on their edges or other types of fasteners known in the art. By positioning the safety strap on the rider just above the knees and positioning the matching loop fastening material on the saddle even with the lower edge of the saddle skirt, the hook and the loop materials are positioned to engage when the rider's legs are in the natural riding position.

In an alternative embodiment of the safety device for the western saddle, a wider version of the loop type fastening material may be held tautly to the saddle by an elastic strap attached to the loop material and fastened about the body of the horse. In addition, loops may be attached to saddle rings to provide more secure fixation of the position of the loop material.

The second version of the present invention is for the equestrian saddle. In one version the safety girth is in the form of an overgirth. The overgirth is simply a strap that lies over the top of the saddle in the region of the pommel so that the safety girth overlays the saddle girth. The top portion of the overgirth is a webbing material; e.g., nylon. On the lower ends of the nylon webbing on either side is a strip of loop type fastening material. The loop type fastening material is designed to lie so that it lines up with the lower edge of the portion of the saddle called the flap and directly over the saddle girth. From the lower end of the flap the device continues as a strip of elastic webbing which is fastened under the horse. In a different version of the equestrian device the loop material is actually attached to the saddle. Instead of passing over the top of the saddle the webbing is screwed directly to the saddle tree by wood screws or the like. In another variation the loop type strip may be in an oval shape instead of a long rectangular strip. The oval shape provides a more generous area for the attachment of the rider to the saddle. The portion of the device that fits on the rider is similar to that for the western saddle except that the nylon strap with the hook type fastening material is designed to fit around the top of the equestrian boot. Since the top of the equestrian boot is curved, the nylon strap and hook type material is desirably also curved to match.

The final version of the present invention is for the jockey saddle. A safety device of this type for a jockey is complicated by the fact that jockeys tend to ride very high in the saddle. It is necessary therefore to take extra measures to ensure that the jockey is able to secure his or her legs to the saddle. This is accomplished by a somewhat more complicated design in that the an elastic portion of the safety girth passes over the top of the saddle. A plurality of overgirths is provided to fan out over the saddle in order to maximize the area of loop type material on the saddle. In one version the loop type fastening material is itself elastic and covers essentially all of the overgirths. In another version the loop type fastening material is fastened in a linear array of patches to an elastic overgirth that passes over the top of the saddle. The attachment of the rider to the jockey saddle is by nylon straps with hook type fastening material that fasten around the jockey boots immediately below the rolled over top of the boots.

In each embodiment, it is desirable that the hook material on the boots or legs of the rider be oriented so that the hooks curve upward. This provides security to the rider in the event of an accident and also allows the rider to more easily detach himself from the saddle in an emergency.

It is therefore an object of the present invention to provide for a rider safety device which is secures a rider to a saddle in the event of accidents and prevents the rider from being thrown from the horse.

It is an additional object of the present invention to provide for a rider safety device which allows the rider to easily extricate himself in an emergency.

Further objects and advantages of the present invention will be apparent from a consideration of the detailed description of the preferred embodiments in conjunction with the drawings which are briefly described as follows:

BRIEF DESCRIPTION OF THE DRAWINGS

FIG. 7 is an embodiment of the equestrian version of the safety girth of the present invention is which the loop type fastening material is attached directly to the saddle.

FIG. 8 is an alternative embodiment of the equestrian version of the safety girth is which an overgirth is employed for fixing the position of the loop type material.

FIG. 9 is a perspective view of the rider safety straps of the present invention as deployed on equestrian type boots.

DETAILED DESCRIPTION OF THE PREFERRED EMBODIMENTS

Figure 2:
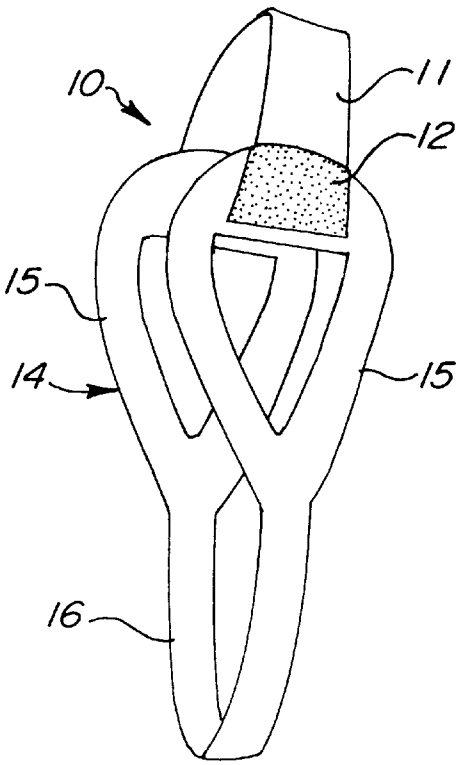
FIG. 2 is a left side elevation of the western saddle embodiment of the safety girth of the present invention shown without the saddle.
Figure 1:
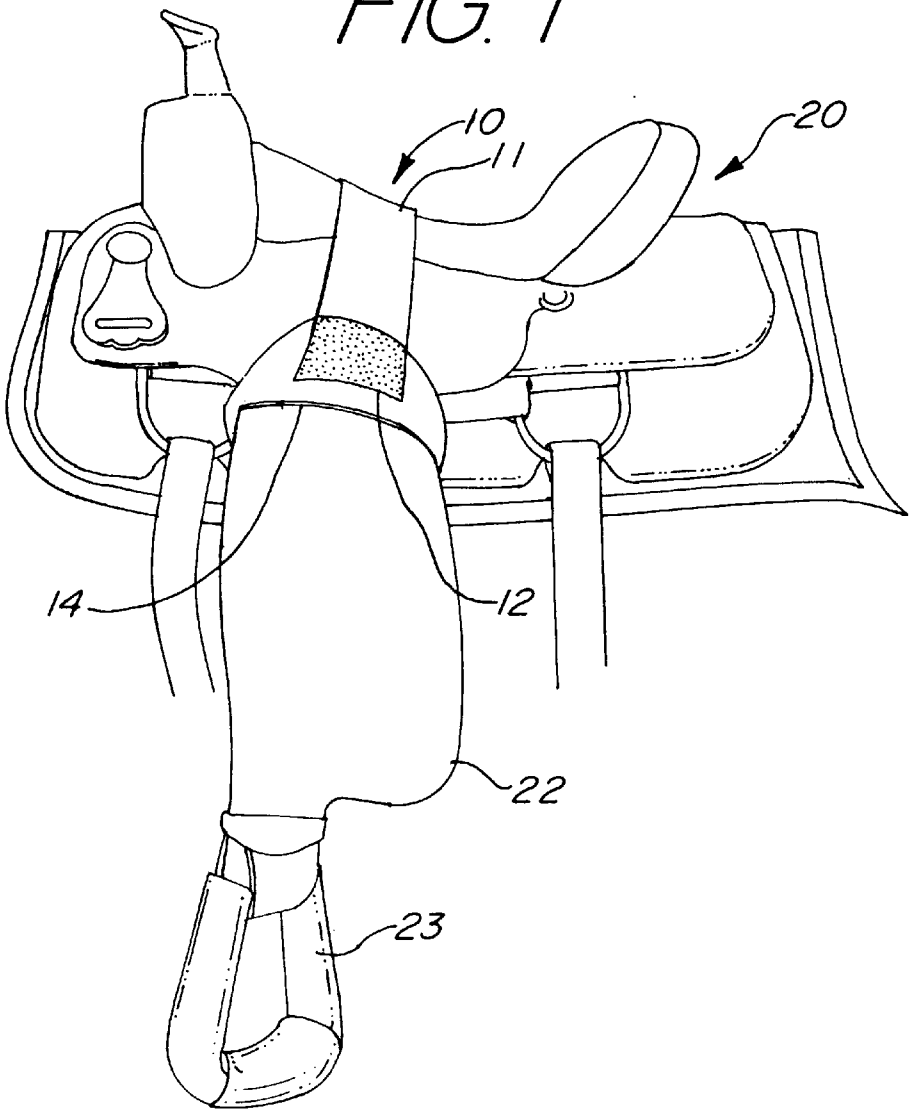
FIG. 1 is a left side elevation of a western riding saddle with the western saddle embodiment of the safety girth of the present invention in place on the saddle.
Figure 4:
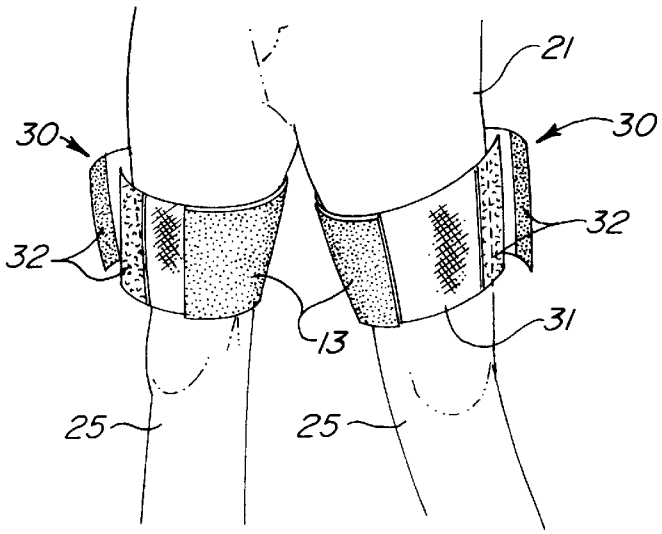
FIG. 4 is a perspective view of the rider safety strap of the western saddle embodiment of the present invention shown as worn on the legs of the rider.
Figure 3:
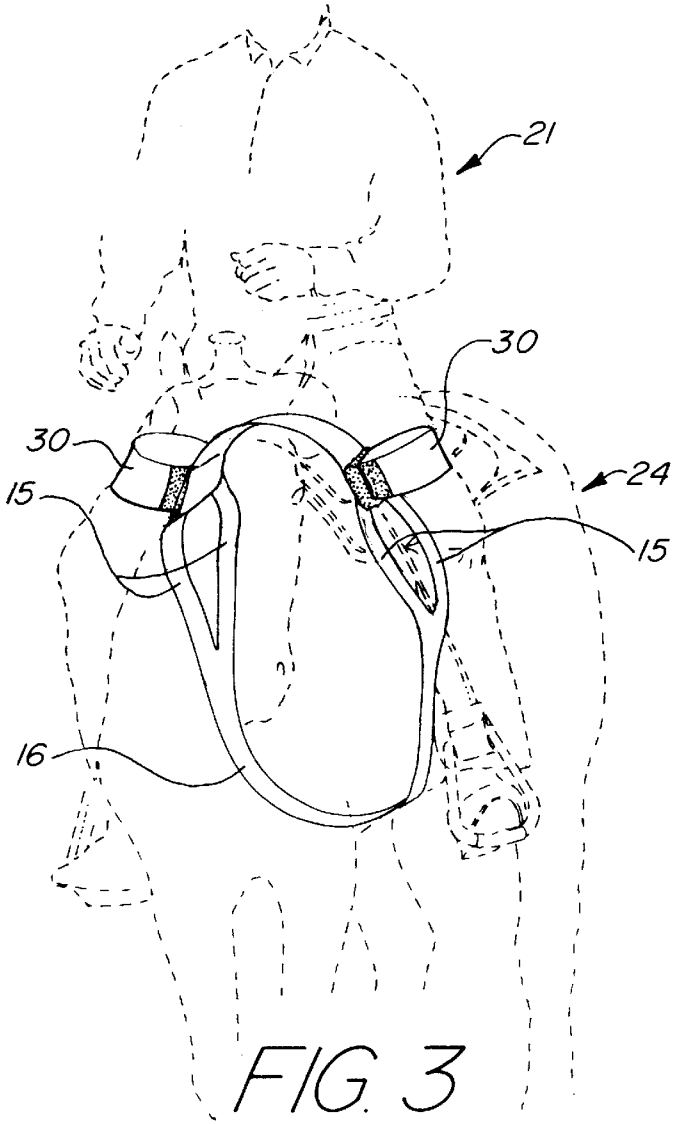
FIG. 3 is a perspective view of the western saddle embodiment of the present invention in use with a horse and rider shown in shadow outline.
Figure 6:
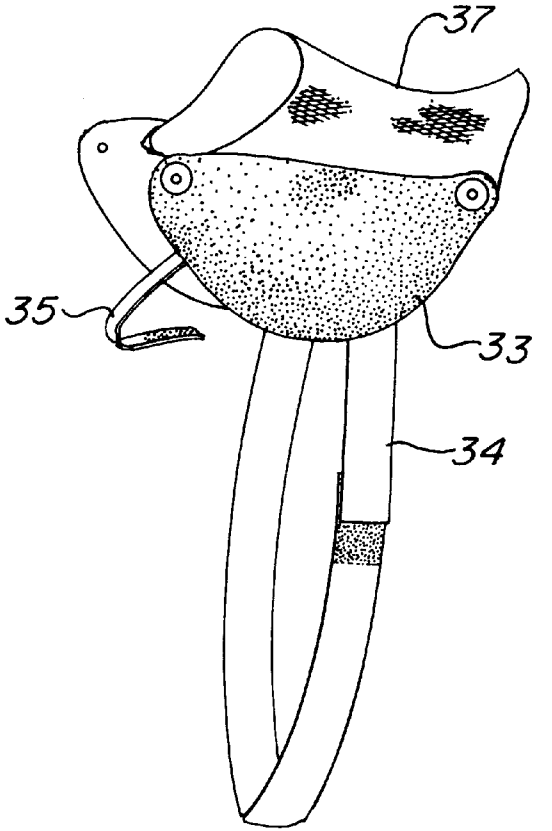
FIG. 6 is a left side elevation view of an alternative embodiment of the western saddle embodiment of the present invention shown without the saddle.
Figure 5:
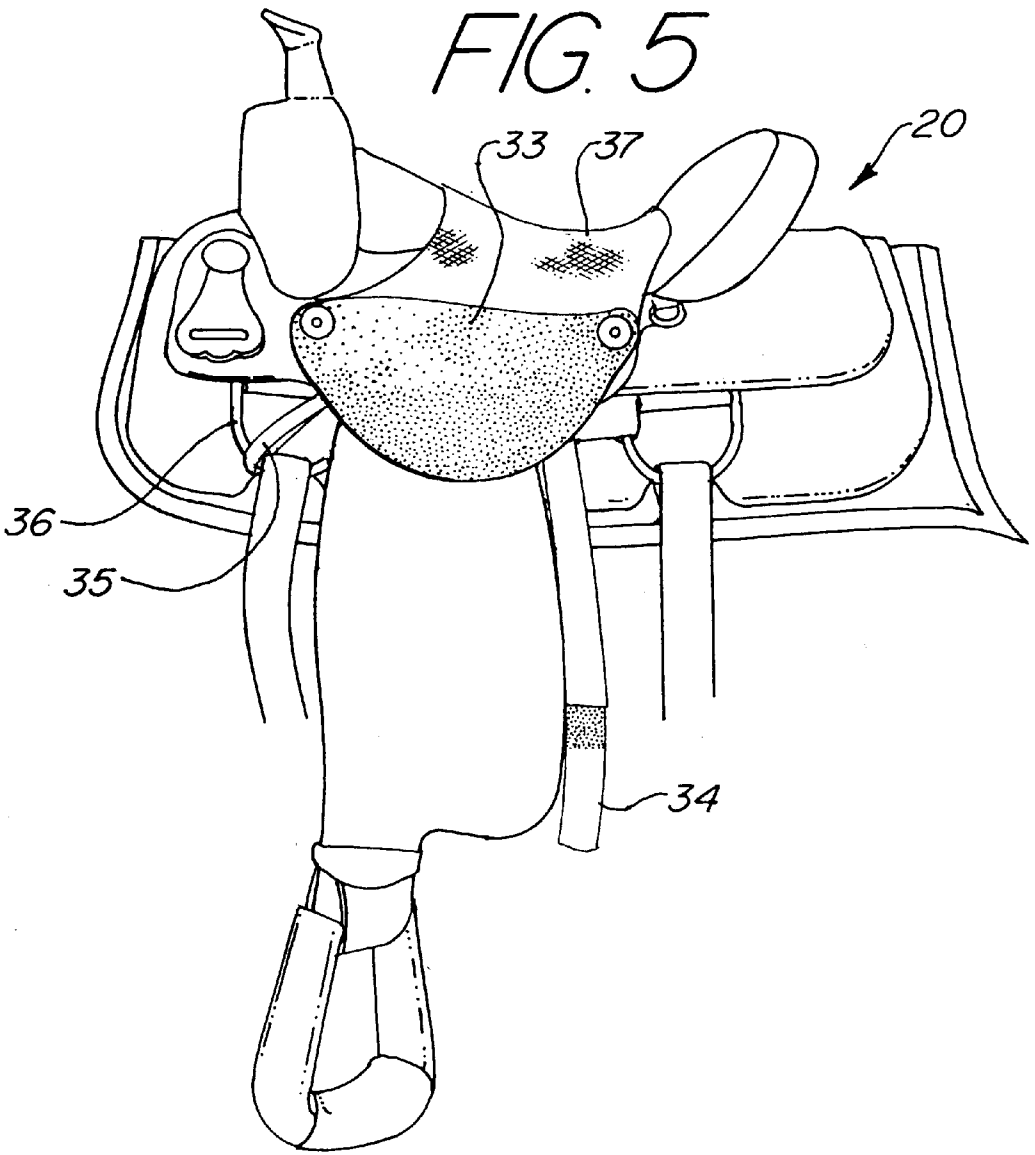
FIG. 5 is a left side elevation view of an alternative embodiment of the western saddle embodiment of the present invention as deployed on the saddle.

The present invention provides a safety device for use by a horseback rider. The invention may be used in conjunction with either the English equestrian style saddle, the western style saddle or the jockey saddle.

Each embodiment employs industrial strength hook and loop fasteners to secure the rider to the saddle thus minimizing unforeseen accidents when the rider may be thrown from the saddle and injured, sometimes severely. Loop material in the preferred embodiment is affixed to the saddle, and the complementary mating hook material in the preferred embodiment is secured to the rider. By engaging the hook material with the loop material, a sufficient binding force is established to prevent the rider from being thrown from the horse in all but the worst accidents. Typical riding accidents involve the rider being thrown forwardly or upwardly from the saddle. The arrangement of the hook and loop material on the sides of the saddle and the inside of the leg of the rider thus provides the maximum holding power in the direction of likely accidental falls, spills, or the like. However, there will be times when for safety the rider must extricate himself or herself from the saddle quickly. The present invention offers no hindrance to such quick exits, since a simple outward leg movement is sufficient to peel away the hook from the loop material. The time required for this maneuver is on the order of a second, or virtually instantaneous.

There are three main variations of the invention—for the western saddle, the equestrian saddle, and the jockey saddle. Each of the major versions also has various individual embodiments. Each of the various embodiments however have the same general characteristics. Each includes a safety girth that attaches to the saddle or around the saddle and which contains a segment of loop type fastening material. Each of the embodiments also includes a matching patch of hook type fastening material which is fastened either to the legs or to the boots of the rider. In some embodiments it is also desirable that the device that attaches to the saddle uses a segment of an elastic material to hold the device tautly to the saddle and to provide a limited degree of freedom of movement to the rider's legs.

With reference to FIGS. 1–6, the first embodiment for the western saddle 20 is described. The saddle portion of the device, called herein a safety girth 10, comprises a strip of webbing 11 that passes over the saddle 20. The webbing 11 may be of various types of materials, such as polyethylene, polypropylene, nylon or light weight leather, so long as the webbing 11 is relatively inelastic. This is desirable to ensure that loop fastening material 12 is positioned appropriately on the saddle 20. However, the webbing 11 may also be an elastic material in circumstances where greater freedom of movement is desired, where the elasticity is helpful in providing a more taut fit to the horse and saddle, or where a degree of elastic stretch is not critical to the functioning of the invention. The loop fastening material 12 must be positioned appropriately for interconnection with the hook fastening material 13 on the rider 21.

The webbing 11 terminates on either side in a patch of loop-type fastening material 12. From the loop fastening material 12 an elastic strap 14 bifurcates and passes on either side of the portion of the saddle 20 known as the fender 22. (The stirrups 23 attach to the lower ends of the fender 22.) The two portions 15 of the bifurcated elastic strap 14 pass on either side of the fender 22 and from thence under the horse 24 where the two bifurcated portions 15 join together into a single strap 16 that passes around and under either side of the horse 24. The two ends of the elastic strap 14 are joined together by buckles, by hook and loop fastening material or other means known in the art. On the western saddle version the portions of the device that attach to the rider, called herein safety straps 30, are simply strips of nylon webbing material 31 with hook type fastening material segments 13 on the inside of the rider's legs 25 above the knee where they are positioned to engage the loop material 12 on the saddle safety girth 10. The nylon strips 31 are fastened about the rider's leg with hook and loop fastening material 32 on their edges or other types of fasteners known in the art.

In an alternative embodiment of the safety device for the western saddle, a wider version of the loop-type fastening material 33 supported on the saddle 20 by a wider strip of webbing 37 may be held tautly to the saddle by an elastic strap 34 attached to the loop material 33 and fastened about the body of the horse 24. In addition, loops 35 may be attached to saddle rings 36 to provide more secure fixation of the position of the loop material 33. The loops 35 as well as the elastic strap 34 may be fastened by buckles, hook and loop fasteners or other fasteners such as would be known in the art.

Figure 11:
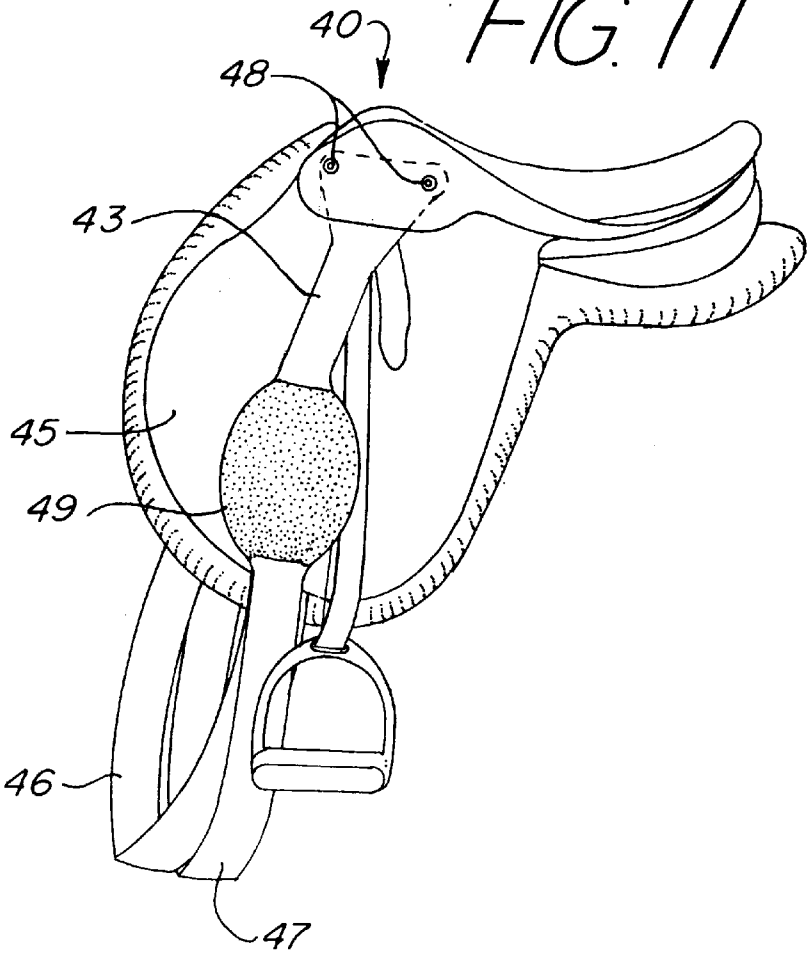
FIG. 11 is a left side elevation of the alternative embodiment of the present invention showing the manner in which the safety girth may be attached directly to the saddle and further showing an alternative embodiment in which the loop type material is oval in outline to afford a greater area for attachment of the hook type material on the rider.

With reference to FIGS. 7–11, the second embodiment of the present invention is for the equestrian saddle 40. In one version as shown in FIG. 8, the safety girth comprises an overgirth 41. The overgirth 41 is simply a strap that lies over the top of the saddle 40 in the region of the pommel 42. The top portion of the overgirth is webbing 43, which may be nylon, polyethylene, polypropylene, nylon, light weight leather, or elastic. On the lower ends of the nylon webbing 43 on either side of the saddle 40 is a strip of loop type fastening material 44. The loop type fastening material 44 lies so that it lines up with the lower edge of the portion of the saddle 40 called the flap 45 and directly over the saddle girth 46. From the lower end of the flap 45 the safety girth continues as a strip of elastic webbing 47 which is fastened under the horse 24. Alternatively, the entire overgirth may be constructed of inelastic material such as nylon webbing or light weight leather. In a different version of the equestrian embodiment of the invention as shown in FIG. 11, the safety girth is actually attached to the saddle 40. Instead of passing over the top of the saddle 40 the webbing 43 is screwed directly to the saddle tree (not shown-the saddle tree is typically a wooden structure located under the saddle leather and providing form to the saddle leather) by wood screws 48 or the like. In another variation as shown in FIG. 11, the loop type segment 49 may be in an oval shape instead of a long rectangular strip. The oval shape provides a more generous area for the attachment of the rider to the saddle. Further as shown in FIG. 7, loop segment 50 may cover a large portion of the flap 45.

Figure 10:
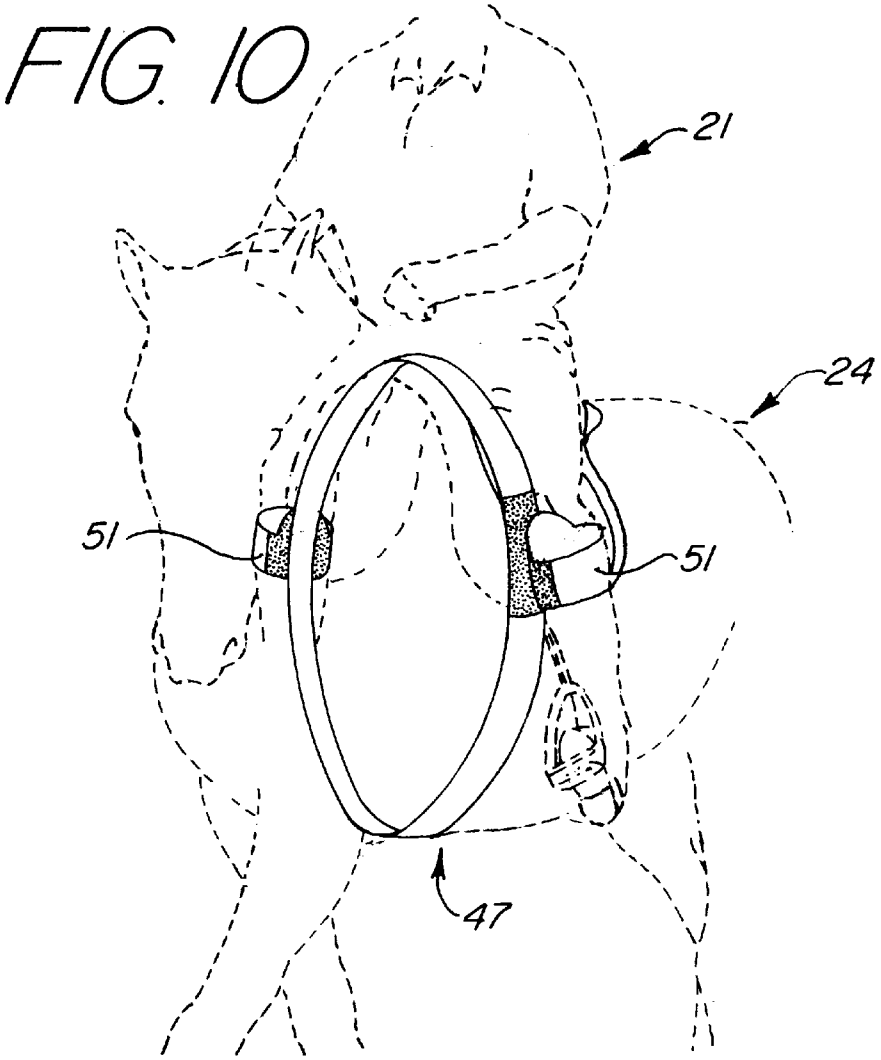
FIG. 10 is a perspective view of the equestrian version of the present invention showing the invention in use on horse and rider with the horse and rider shown in shadow outline.
Figure 13:
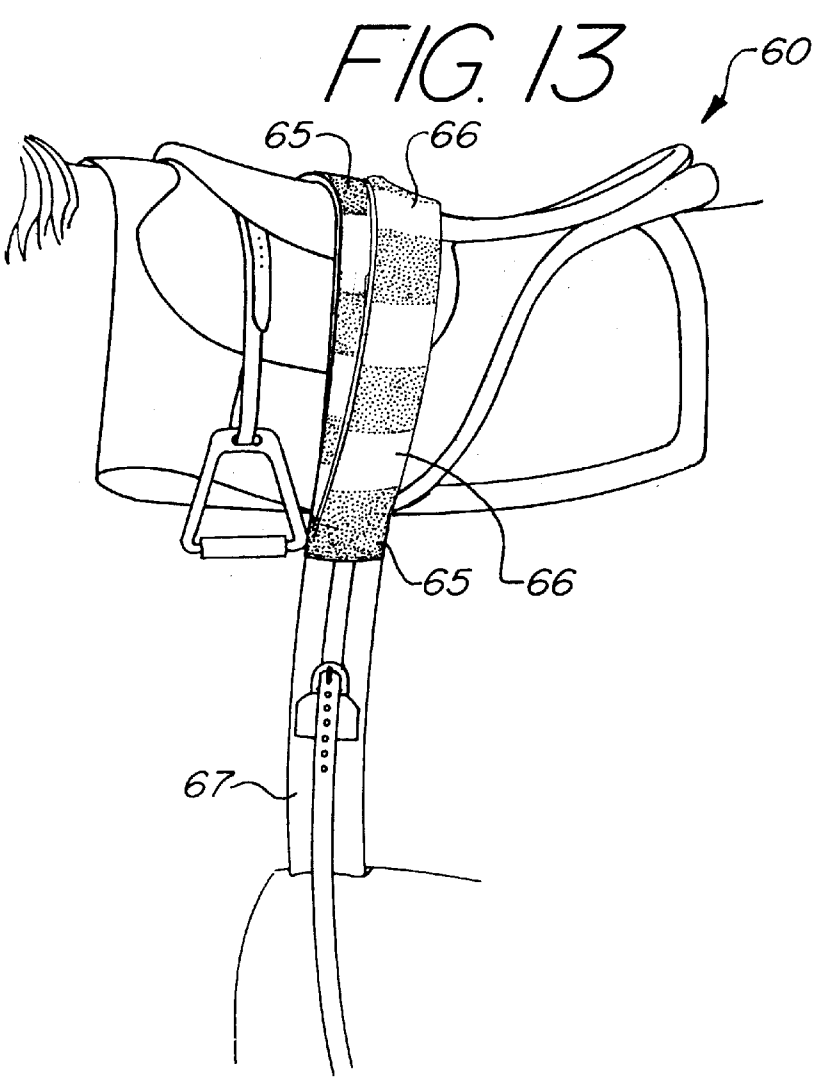
FIG. 13 is a left side elevation of the jockey saddle version of the safety girth of the present invention showing another embodiment in which a plurality of overgirths are fanned over the top of the saddle. In this embodiment the loop type material is inelastic and is arrayed in linear patches along the elastic overgirths.

The equestrian rider safety strap 51 for the equestrian saddle 40 as shown in FIGS. 9 and 10 is similar to that for the western saddle 20 except that a nylon strip 52 with hook type fastening material 53 is designed to fit around the top of the equestrian boot 54. Since the top 55 of the equestrian boot 54 is curved, the nylon strip 52 and hook type material 53 are desirably also curved to match.

FIG. 10 illustrates the use of the safety girth 41 on a horse 24 with an equestrian saddle 40 in conjunction with a rider 21 wearing safety straps 51 on the equestrian boots 54.

With reference to FIGS. 12–15, the third embodiment of the present invention is for the jockey saddle 60. A safety device of this type for a jockey is complicated by the fact that jockeys tend to ride very high in the saddle. It is necessary therefore to take extra measures to ensure that the jockey is able to secure his or her legs to the saddle 60. This is accomplished by a somewhat more complicated design in that a plurality of overgirths 61 is provided to fan out over the top of the saddle 60. Since the overgirths 61 are substantially covered with loop material 62, the area of loop type material 62 exposed for contact by the corresponding hook material 63 on the jockey boot 64 is maximized. The overgirths 61 are attached to a safety girth strap 67 which passes under the horse 24 and is fastened with buckles, hook and loop fasteners or other fastening means known in the art.

Figure 12:
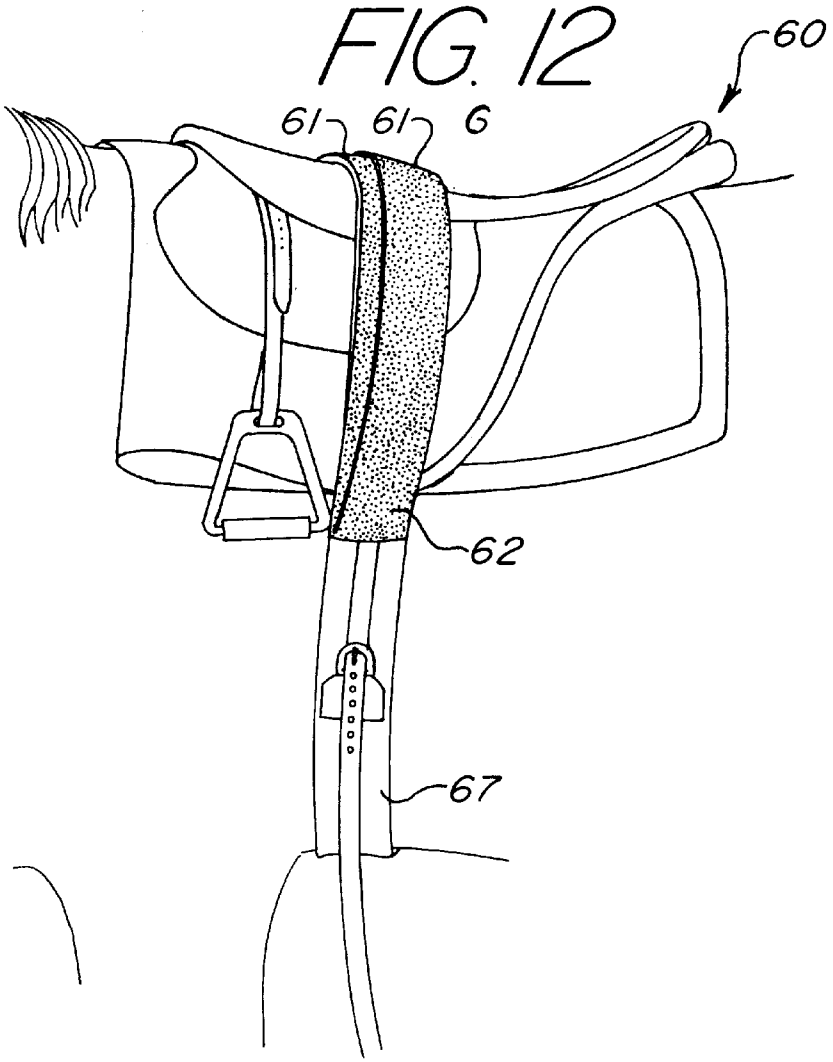
FIG. 12 is a left side elevation of the jockey saddle version of the safety girth of the present invention showing the embodiment in which a plurality of overgirths are fanned over the top of the saddle. In this embodiment the loop type material is elastic and covers substantially all of the overgirths.

In one version the loop type fastening material 62 is itself elastic and covers essentially all of the overgirths 61 as shown in FIG. 12. In another version the loop type fastening material is fastened in a linear array of patches 65 to an elastic overgirth 66 that passes over the top of the saddle 60.

Figure 14:
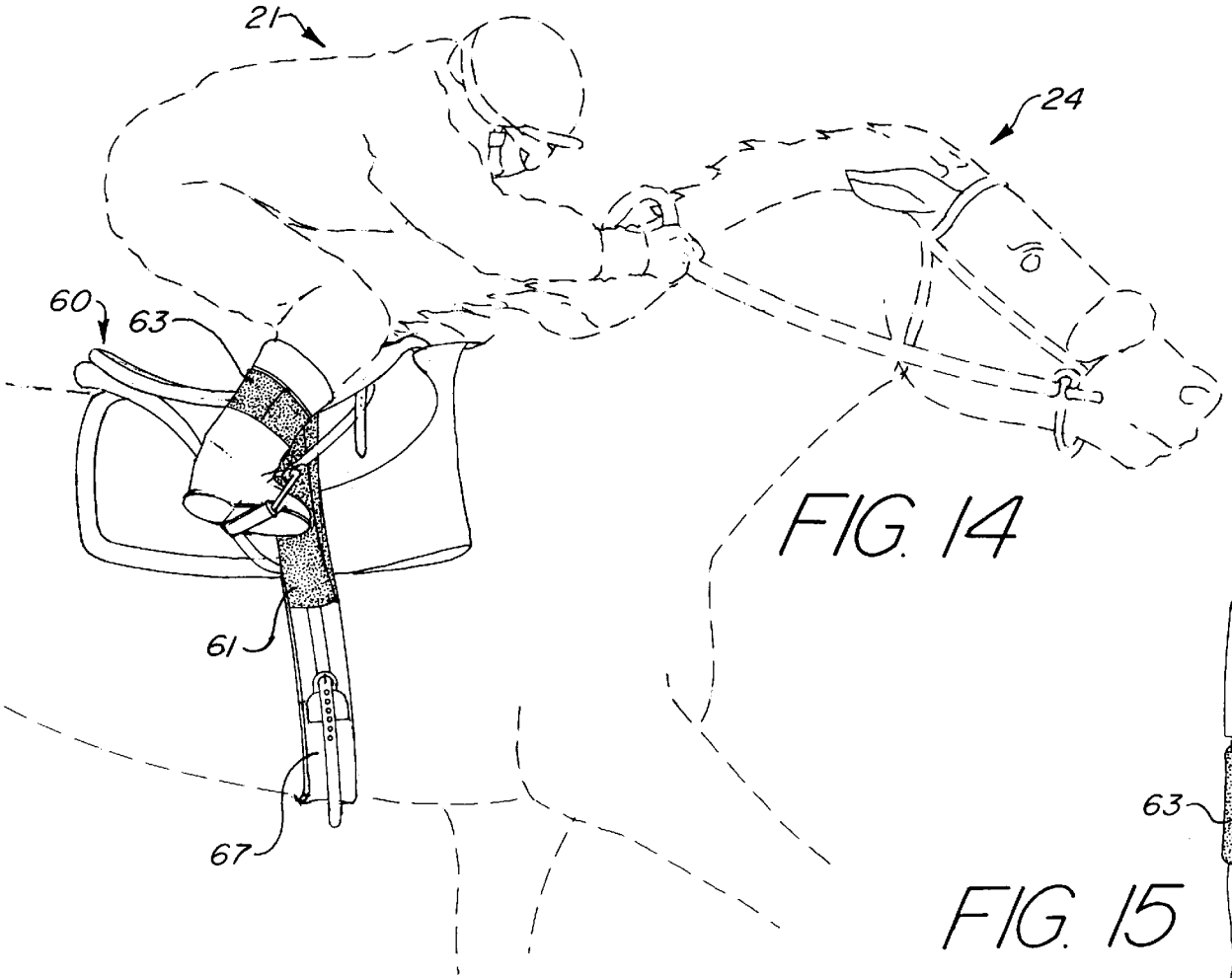
FIG. 14 is a left side elevation of the jockey saddle embodiment of the present invention shown in use by a horse and rider in which the horse and rider are shown in shadow outline.
Figure 15:
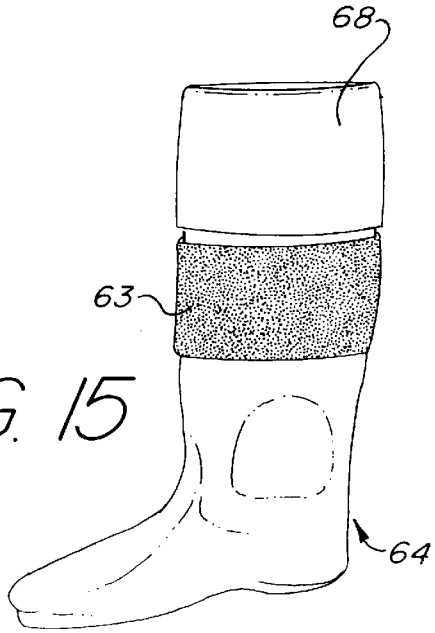
FIG. 15 is a perspective view of a jockey boot with the rider safety strap positioned below the rolled over top of the jockey boot.

The attachment of the rider 21 to the jockey saddle 60 is by nylon strips (not shown in FIG. 15) covered with hook type fastening material 63 that fastens around the jockey boots 64 immediately below the rolled over top 68 of the boots 64. Alternatively, the nylon strips or hook type fastening material 63 may be attached directly to the jockey boot 64; e.g., by sewing to the jockey boot 64. The use of the safety girth by a rider 21 on a horse 24 is illustrated in FIG. 14.

In each embodiment described above, it is desirable that the hook material on the boots or legs of the rider be oriented so that the hooks curve upward. This provides security to the rider in the event of an accident and also allows the rider to more easily detach himself from the saddle in an emergency.

The hook and loop type material suitable for the practice of the present invention is desirably an industrial grade of hook and loop type fastener having a holding power of preferably at least 14 pounds per square inch. A suitable type of hook and loop fastener is the type sold by Velcro USA, Inc., 406 Brown Avenue, P.O. Box 5218, Manchester, N.H. 03108 under the Velcro tradename. In particular, hook material of the type known as hook 88, HTH-705 and loop material of the type known as loop 1000, 3001 has been found to be effective.

The present invention has been described with reference to certain preferred and alternative embodiments which are intended to be exemplary only and not limiting to the full scope of the invention as set forth in the appended claims.

What is claimed is:

1. In combination, a horse riding saddle and a safety device for releasably securing the legs of a rider, wherein the combination comprises:

a riding saddle having a girth for securing said saddle on the back of a horse, said girth being secured to said saddle and passing around the body of the horse and having means to secure said saddle about the body of the horse;

a safety strap securable to the leg of the rider comprising a segment of hook-type fastening material;

a safety girth securable about the body of the horse, comprising a saddle strap, a segment of loop-type fastening material attached to said saddle strap, and means to secure said segment of loop-type fastening material to said saddle in a position relative to said saddle to releasably interconnect with said segment of hook-type fastening material on said safety strap securable to the leg of the rider when the rider is mounted upon said saddle.

2. The combination of claim 1 wherein said saddle strap further comprises a strap of elastic material.

3. The combination of claim 1 wherein said segment of hook-type fastening material comprises a plurality of hooks and further wherein said hooks are oriented such that said hooks face upwardly when the rider is mounted on the saddle.

4. The combination of claim 1 wherein said means to secure said segment of loop-type fastening material to said saddle comprises an overgirth attached to said segment of loop-type fastening material and further wherein said overgirth comprises inelastic material passing over said saddle.

5. The combination of claim 4 wherein said saddle comprises a fender and wherein said saddle strap comprises a bifurcated segment passing to either side of said fender.

6. The combination of claim 5 wherein said strap securable to the leg of the rider comprises means for securing said strap about the leg of the rider above the knee of the rider.

7. The combination of claim 4 wherein and said strap securable to the leg of the rider comprises means for securing said strap about the top of said boot.

8. The combination of claim 7 wherein said a boot worn by the rider is provided with a rolled over top and said strap securable to the leg of the rider comprises means for securing said strap about the top of said boot below said rolled over top.

9. The combination of claim 7 wherein said boot has a curved top and said segment of hook-type fastening material conforms to said curved top.

10. The combination of claim 4 wherein said overgirth comprises a plurality of fanned segments passing over the top of said saddle.

11. The combination of claim 10 wherein said segment of loop-type fastening material is elastic and covers substantially the entire surface of said plurality of overgirths.

12. The combination of claim 10 wherein said segment of loop-type fastening material comprises a plurality of inelastic segments mounted to an elastic substrate such that said inelastic segments in combination with said elastic substrate covers substantially the entire surface of said plurality of overgirths.

13. The combination of claim 1 wherein said saddle comprises a solid core and wherein said means to secure said segment of loop-type fastening material to said saddle comprises means to fasten said segment of loop-type fastening material to said solid core.

14. The combination of claim 1 wherein said segment of loop-type fastening material is substantially rectangular in shape.

15. The combination of claim 1 wherein said segment of loop-type fastening material is substantially oval in shape.

* * * * *